United States Patent [19]

Thompson

[11] Patent Number: 4,914,778

[45] Date of Patent: Apr. 10, 1990

[54] TWO WAY MOP

[75] Inventor: Dewey T. Thompson, LaGrange, Ga.

[73] Assignee: Milliken Research Corporation, Spartanburg, S.C.

[21] Appl. No.: 281,290

[22] Filed: Dec. 8, 1988

[51] Int. Cl.[4] ..... A47L 13/253

[52] U.S. Cl. ..... 15/229.4; 15/229.8

[58] Field of Search ..... 15/147 R, 147 A, 229.1, 15/229.4, 229.8

[56] References Cited

U.S. PATENT DOCUMENTS

| | | | |
|---|---|---|---|
| 2,967,320 | 1/1961 | Short | 15/229.8 X |
| 3,029,454 | 4/1962 | Short et al. . | |
| 3,082,456 | 3/1963 | Short . | |
| 3,711,885 | 1/1973 | Griffin et al. | 15/229.4 |
| 3,822,435 | 7/1974 | Moss | 15/229.8 |
| 4,382,310 | 5/1983 | Moss . | |

*Primary Examiner*—Edward L. Roberts

*Attorney, Agent, or Firm*—Earle R. Marden; H. William Petry

[57] ABSTRACT

A mop head for a slip-through or breakdown mop frame which has a pocket on each end of substantially the same length to secure the mop frame therein. One of the products is open at its outer end and can be closed with a snap fastener to prevent the mop frame from slipping therethrough.

4 Claims, 2 Drawing Sheets

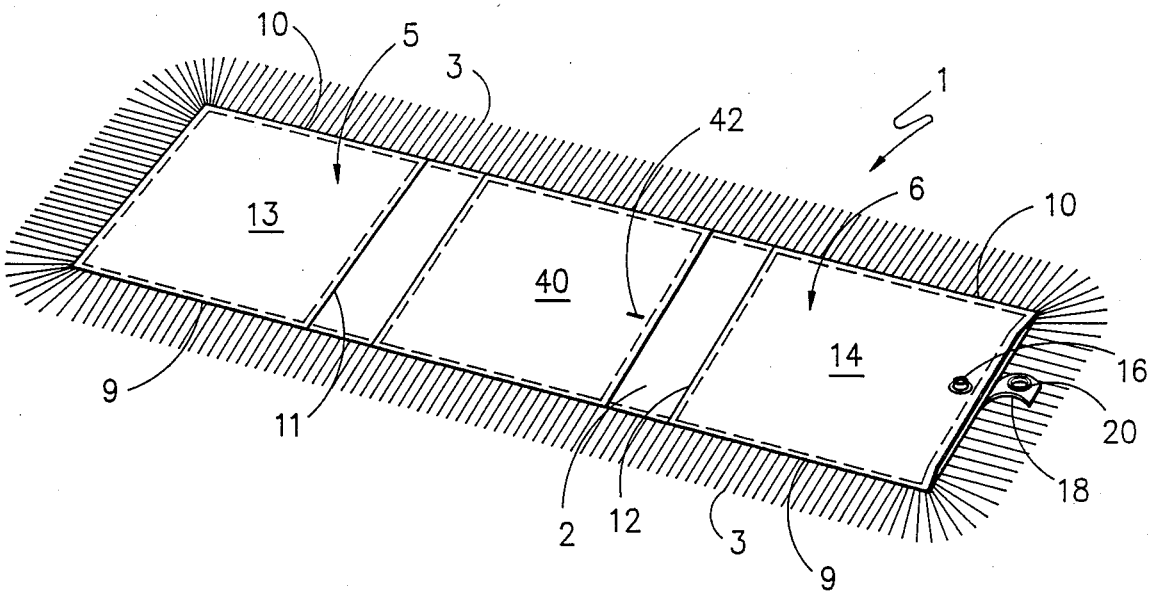
FIG. — 1 —
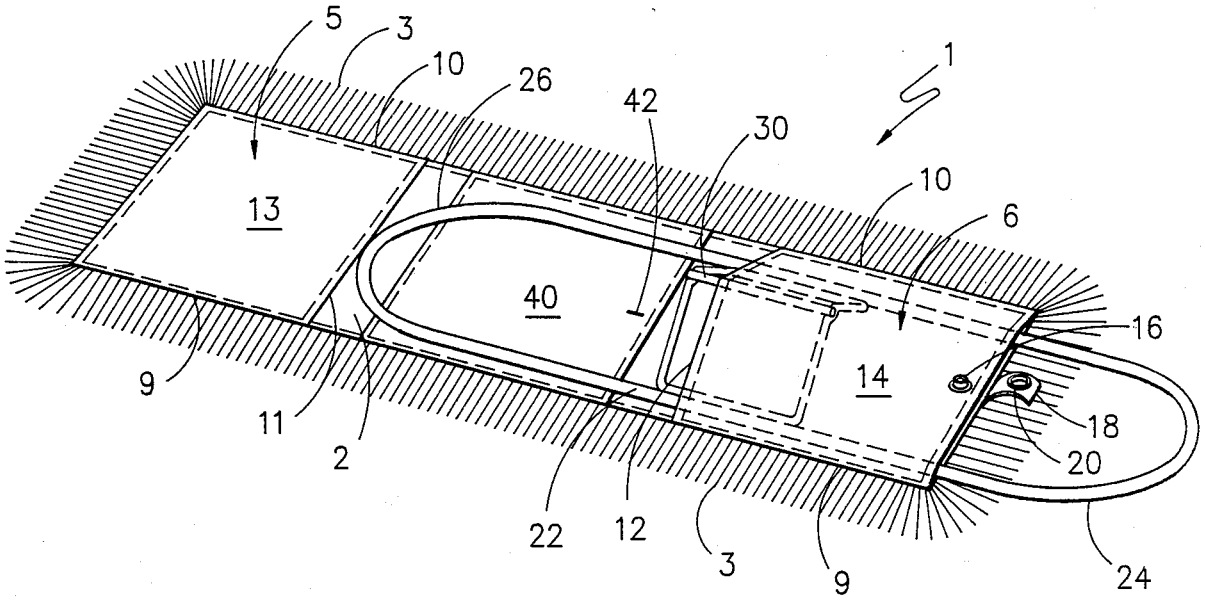
FIG. — 2 —

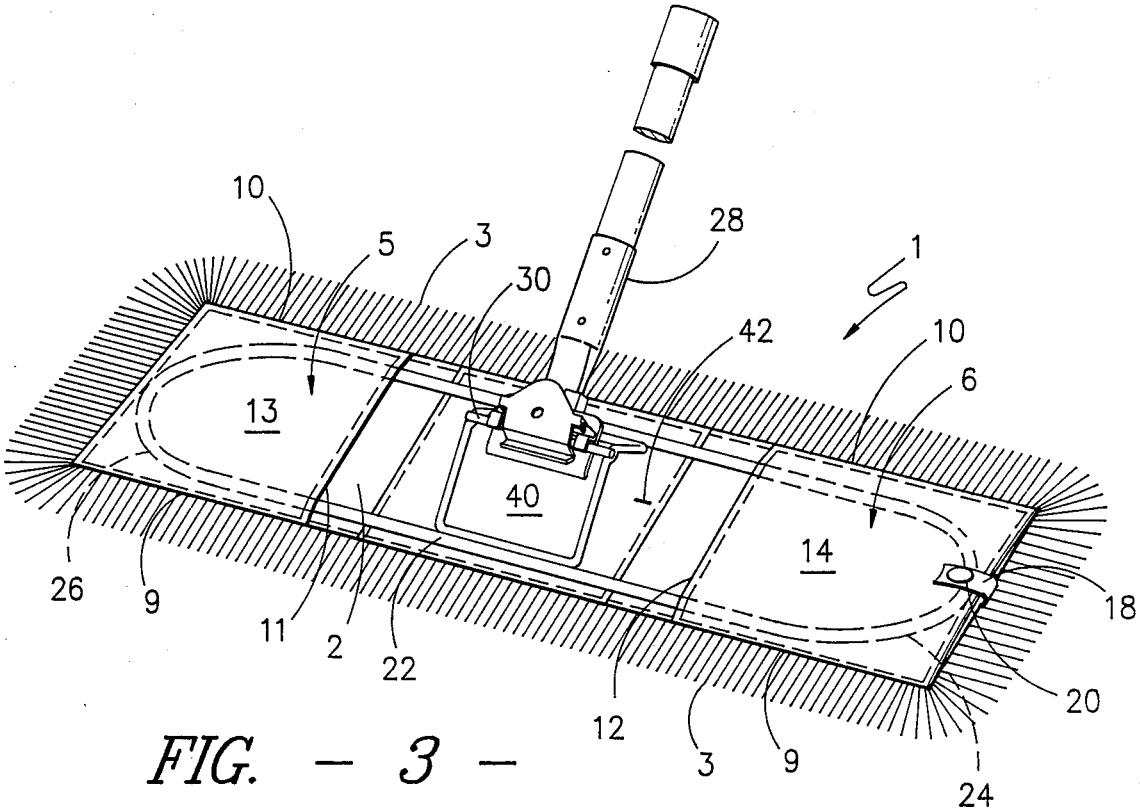
FIG. — 3 —
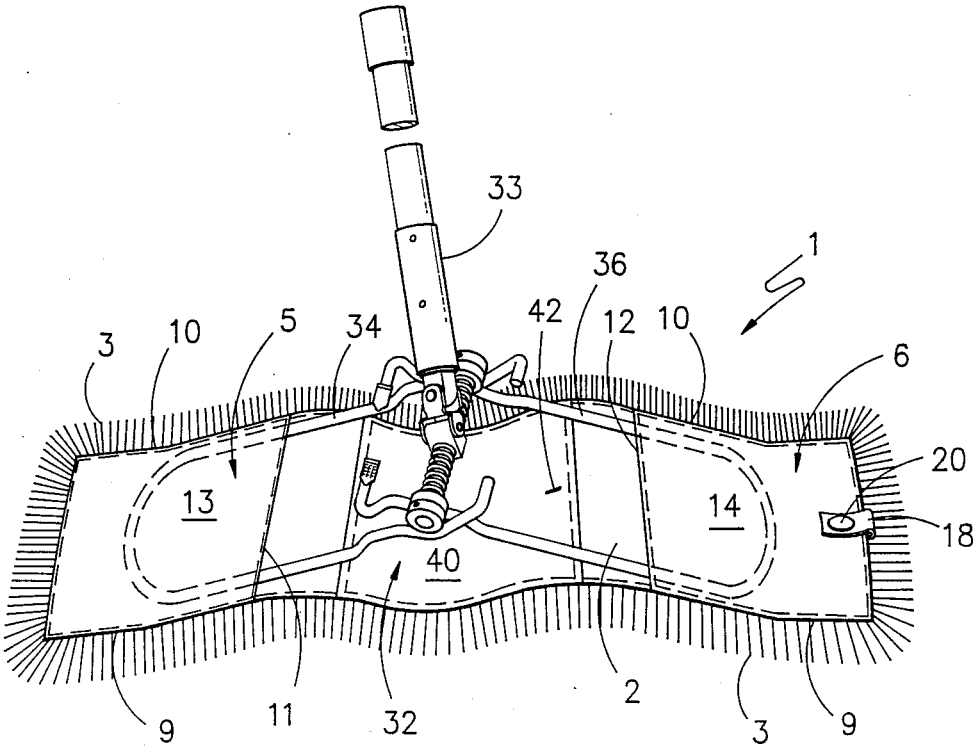
FIG. — 4 —

TWO WAY MOP

This invention relates generally as indicated to a dust mop with improved backing which includes provision for receipt of both a slip-through or breakdown-type mop frame.

Heretofore, it was the usual practice to provide a dust mop with a backing which would receive either a slip-through or a breakdown-type frame, but not both. Some backings are universal in the sense that they can be tied to either type of frame. However, the ties are not always as secure as one would like, in that they are always susceptible to coming undone, and such ties are also subject to wear and breakage.

With the foregoing in mind, it is the principal object of this invention to provide a dust mop with a backing which will readily accommodate both types of frames.

Another object is to provide such a dust mop with a backing that does not require the use of any flaps or ties to secure the mop to a dust mop frame.

Still another object is to provide such a dust mop with a backing of the type described which is relatively simple in construction and easy to manufacture and has a relatively long, trouble-free life.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, but one of the various The invention to be described below is shown in the attached drawings in which:

FIG. 1 is a perspective view of the new and improved mop head;

FIG. 2 illustrates the mop head of FIG. 1 with a rigid slip-through frame being placed into position;

FIG. 3 shows the rigid slip-through frame in position in the mop head with the mop handle attached, and FIG. 4 illustrates the installation of a breakdown mop frame.

Referring now in detail to the drawing, and initially to FIGS. 1 through 3 thereof, there is shown a dust mop 1 including a fabric backing 2 to one side of which yarns or yarn-like material 3 are secured as by stitching or tufting. The term "yarns" as used herein is a generic term which covers all yarn and cord-like materials suitable for use in a dust mop. As described hereinafter, the backing 2 includes provision for receipt of both a slip-through and breakdown-type mop frame.

Attached to the other or back side of the backing adjacent the opposite ends thereof are a pair of oppositely facing pockets 5 and 6 formed as by stitching a piece of fabric material to the backing 2 along the sides 9 and 10 leaving the inner ends 11 and 12 of each fabric piece 13 and 14 open. For reasons hereinafter explained the outside end of pocket 5 is stitched closed while the outside end of pocket 6 is left open and is closed by a snap fastener. The snap fastener is composed of a male-type tongue or stub member 16 attached to and extending upwardly from the fabric piece 14 and a female connector 20 connected to the strap 18 sewn stitched to the backing 2. The fabric pieces 13 and 14 are substantially the same length providing pockets 5 and 6 which are substantially the same depth. It can be seen that having the fabric pieces 13 and 14 the same size provides ease of manufacture and prevents mix-up during fabrication since the fabricator does not have to worry over whether the correct size pocket pieces have been selected.

Looking in particular to FIGS. 2 and 3 the installation of a slip-through mop frame 22 is shown. In FIG. 2 the mop frame 22 is slid into the outer open end of the pocket 6 which allows the end 24 to project outwardly therefrom since the connectors 16 and 20 are not interengaged. When the end 26 reaches the inner end of pocket 5 the mop frame 22 is then slid further in the same direction with the end 26 going into the pocket until it reaches the position shown in FIG. 3. The female connection 20 is then snapped onto the stud 16 to maintain the frame 22 in the mop head 1. Then a releasable mop handle 28 shown in U.S. Pat. No. 3,029,454 can be snapped onto the rod 30 of the mop frame 22.

FIG. 4 shows a breakdown mop frame 32 of the type shown in U.S. Pat. No. 3,082,456 which allows the arms 34 and 36 to be bent downwardly so that they will slide into the pockets 5 and 6 as they are rotated to the horizontal position and locked therein. In this form of the invention the stud 16 and connector 20 stay in the engaged position.

A protective fabric covering 40 may also be provided over the center portion of the backing 2 intermediate the inner ends of the pockets 5 and 6 to prevent undue abrasion of the backing during insertion and removal of the frames and while being used. Preferably, such protective fabric covering is stitched to the fabric backing at the sides thereof and bar tacked at 42 to prevent the mop frame 22 from sliding thereunder during insertion. Also, the ends and sides of the protective fabric covering may be surged with thread for added strength.

Although different types of material may be used for the pockets and cross member as well as the protective fabric backing, a highly wear-resistant material such as nylon is preferably used. Also, such material preferably has a multitude of openings therein which have the advantage that they allow the dust mop to be washed out cleanly and dried quickly.

From the foregoing, it will now be apparent that the backing for the dust mop of the present invention provides a very simple and effective means for securely attaching the dust mop both to a slip-through or breakdown-type frame without the use of any ties or the like. Also, such backing is of a sturdy construction and should provide for a relatively long trouble-free life.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows.

1. A mop head comprising: a backing having a plurality of yarns secured to one face thereof, the other face of said backing having oppositely facing pockets adjacent the ends thereof, said pockets being substantially the same size and being open at their inner ends for receipt of the ends of either a slip-through or breakdown-type of mop frame, one of said pockets having its outer end open and means operably associated with said open outer end to selectively block off a portion of said outer end to prevent a mop frame from slipping therethrough.

2. The mop head of claim 1 wherein said means is a snap fastener of the type having a male and female connection.

3. The mop head of claim 1 wherein a fabric is mounted to said backing material between said pockets, said fabric being attached to the sides of said backing material and tacked to said backing at the side thereof closest to said pocket having an open outer end.

4. The mop head of claim 3 wherein said means is a snap fastener of the type having a male and female connection.

* * * * *

UNITED STATES PATENT AND TRADEMARK OFFICE

CERTIFICATE OF CORRECTION

PATENT NO. : 4,914,778

DATED : April 10, 1990

INVENTOR(S) : Dewey Tillman Thompson

It is certified that error appears in the above-identified patent and that said Letters Patent is hereby corrected as shown below:

Column 1, line 32 after "various" insert --ways in which the principles of the invention may be employed.--

Column 2, before line 60 and after line 59 insert --I CLAIM:--

Signed and Sealed this

Seventeenth Day of September, 1991

*Attest:*

HARRY F. MANBECK, JR.

*Attesting Officer*

*Commissioner of Patents and Trademarks*